US010325465B2

(12) United States Patent
Svoboda et al.

(10) Patent No.: US 10,325,465 B2
(45) **Date of Patent: *Jun. 18, 2019**

(54) BUILDING SECURITY SYSTEM

(71) Applicant: WACARI GROUP, LLC, Boulder, CO (US)

(72) Inventors: John Svoboda, Boulder, CO (US); Kerry Driggers, Westminster, CO (US); Ronald P. Earhart, Arvada, CO (US)

(73) Assignee: WACARI GROUP, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/840,537

(22) Filed: Dec. 13, 2017

(65) Prior Publication Data

US 2018/0102033 A1 Apr. 12, 2018

Related U.S. Application Data

(63) Continuation of application No. 15/149,476, filed on May 9, 2016, now Pat. No. 9,886,831.

(Continued)

(51) Int. Cl.
*G08B 15/00* (2006.01)
*G08B 7/06* (2006.01)

(52) U.S. Cl.
CPC ..... *G08B 15/00* (2013.01); *G08B 7/06* (2013.01)

(58) Field of Classification Search
CPC ..... G08B 7/06; G08B 7/062; G08B 7/064; G08B 7/08; G08B 13/00; G08B 13/18;

(Continued)

(56) References Cited

U.S. PATENT DOCUMENTS 5,790,019 A 8/1998 Edwin
5,886,620 A 3/1999 Stewart et al.

(Continued)

FOREIGN PATENT DOCUMENTS

WO WO 2014/134217 9/2014

OTHER PUBLICATIONS

A Study of Active Shooter Incidents in the United States Between 2000 and 2013, U.S. Department of Justice, Federal Bureau of Investigation, 2013, 47 pages.

(Continued)

*Primary Examiner* — Van T Trieu
(74) *Attorney, Agent, or Firm* — Sheridan Ross PC

(57) ABSTRACT

Visual and aural emitters and methods of providing a building security system distracting to an armed assailant are provided. More particularly, a permanent and fixed installation of stroboscopic lights and aural sirens that operate at sufficient and appropriate frequency, duration and intensity to potentially impair an armed assailant while remaining non-injurious and nonlethal. The system may deliver sufficient sensory distraction such that all occupants of the space are impaired in their ability to perform certain tasks employing vision or hearing with cognitive clarity, including targeting victims with a firearm. The system may be activated manually by authorized personnel, automatically by one or more sensor triggers, or remotely by law enforcement officials.

20 Claims, 6 Drawing Sheets

Related U.S. Application Data

(60) Provisional application No. 62/158,225, filed on May 7, 2015.

(58) Field of Classification Search
CPC .... G08B 13/181; G08B 13/189; G08B 15/00; G08B 15/002
See application file for complete search history.

(56) References Cited

U.S. PATENT DOCUMENTS

| | | | | |
|---|---|---|---|---|
| 6,028,514 | A | 2/2000 | Lemelson et al. | |
| 6,190,022 | B1 | 2/2001 | Tucci et al. | |
| 6,876,302 | B1 | 4/2005 | Steeves | |
| 6,954,137 | B2 | 10/2005 | Stewart et al. | |
| 7,040,780 | B2 | 5/2006 | Diehl | |
| 7,180,426 | B2 | 2/2007 | Rubtsov | |
| 7,497,586 | B2 | 3/2009 | Eisenberg et al. | |
| 7,794,102 | B2 | 9/2010 | Shemwell et al. | |
| 7,980,720 | B2 | 7/2011 | Shemwell et al. | |
| 8,051,761 | B1 | 11/2011 | Ullman et al. | |
| 9,332,616 | B1 * | 5/2016 | Modi | H05B 37/0281 |
| 9,886,831 | B1 | 2/2018 | Svoboda | |
| 2002/0003470 | A1 | 1/2002 | Auerbach | |
| 2006/0017560 | A1 | 1/2006 | Albert | |
| 2006/0234191 | A1 | 10/2006 | Ludman | |
| 2011/0069585 | A1 | 3/2011 | Baxter et al. | |
| 2011/0170798 | A1 | 7/2011 | Tidhar | |
| 2012/0217882 | A1 | 8/2012 | Wong et al. | |
| 2014/0018782 | A1 | 1/2014 | Flynn | |
| 2016/0112681 | A1 * | 4/2016 | Kaestle | A61B 5/11 348/78 |
| 2016/0189526 | A1 * | 6/2016 | Kennedy | G08B 13/08 340/541 |
| 2016/0189527 | A1 * | 6/2016 | Peterson | G08B 25/008 340/541 |
| 2017/0105265 | A1 | 4/2017 | Sadwick | |

OTHER PUBLICATIONS

"Critical Issues in Policing Series, The Police Response to Active Shooter Incidents," Police Executive Research Forum, 2014, 60 pages.

"DoD Non-Lethal Capabilities: Enhancing Readiness for Crisis. Response," U.S. Department of Defense, Non-Lethal Weapons Program Annual Review, 2015, pp. 1-28.

Bertomen, "You strobe, I strobe, we all strobe together: strobes give officers a tactical advantage over suspects," Law Enforcement Technology, 2007, retrieved from http://www.officer.com/article/10249743/you-strobe-i-strobe-we-all-strobe-together, 3 pages.

Blair et al., "United States Active Shooter Events from 2000 to 2010: Traiing and Equpment Implications," Texas State University, 2013, 10 pages.

Davison, "The Early History of 'Non-Lethal' Weapons," Occasional Paper No. 1, Bradford Non-Lethal Weapons Research Project (BNLWRP), Department of Peace Studies, University of Bradford, UK, 2009, 325 pages.

Duncan, "A Primer on the Employment of Non-lethal Weapons," Naval Law Review, 1998, vol. 45(1), 55 pages.

Harding, "Photosensitivity: a vestigial echo?," The first Grey Walter Lecture, International Journal of Psychophysiology, 1994, vol. 16, pp. 273-279, abstract only, 1 page.

Levine et al., "U.S. Military Use of Non-Letal Weapons: Reality vs Perceptions," Case Western Researve Journal of International Law, 2015, vol. 47(1), 27 pages.

Lewer et al., "Non-lethal technologies—an overview," In Disarmament Forum, 2005, vol. 1, pp. 37-51.

Lewer, "Non-Lethal Weapons," Medicine and War, 1995, vol. 11(2), pp. 78-90, abstract only, 1 page.

Miller et al., "Edge-light pupil cycle time," British Journal of Ophthalmology, 1978, vol. 62(7), pp. 495-500.

Mills et al., "Trends in Recommended Illuminance Levels: An International Comparison," Journal of the Illuminating Engineering Society, 1999, vol. 28(1), pp. 155-163.

Namorato, "A concise history of acoustics in warfare," Applied Acoustics, 2000, vol. 59(2), pp. 101-135, abstract only, 1 page.

Nutley, "Non-Lethal Weapons: Setting Our Phasers on Stun? Potential Strategic Blessings and Curse of Non-Lethal Weapons on the Battlefield," Occasional Paper No. 34, Center for Strategy and Technology, Air University, Maxwell Air Force Base; Alabama, 2003, 74 pages.

Ohlbaum, "Mechanical Resonant Frequency of the Human Eye in Vivo," No. AMRL-TR-75-113, Aerospace Medical Research Laboratory, Wright-Patterson AFB OH, 1976, 106 pages.

Rozanowska et al., "Light-induced Damage to the Retina: Role of Phodopsin Chromophore Revisited," Photochemistry and Photobiology, 2005, vol. 81, pp. 1305-1330.

Schweit, "Addressing the Problem of the Active shooter," FBI Law Enforcement Bulletin, May 7, 2013, 5 pages.

Takahashi et al., "Techniques of Intermittent Photic Stimulation and Paroxysmal Responses," American Journal of EEG Technology, 1989, vol. 29(3), pp. 205-218, abstract only, 1 page.

Vinokur, "Acoustic Noise as a Non-Lethal Weapon," Sound and Vibration, 2004, vol. 38(10), pp. 19-23.

Official Action for U.S. Appl. No. 15/149,476, dated Apr. 21, 2017, 15 pages.

Notice of Allowance for U.S. Appl. No. 15/149,476, dated Sep. 13, 2017, 7 pages.

* cited by examiner

FIG. 4
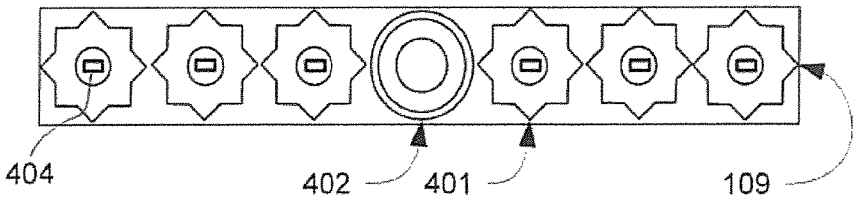
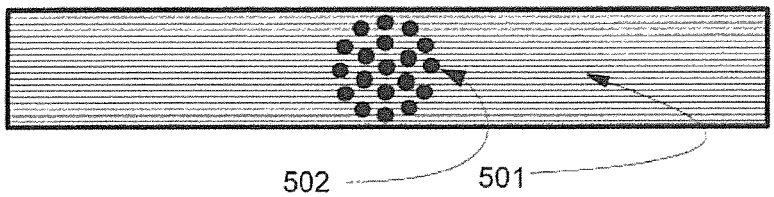
FIG. 5
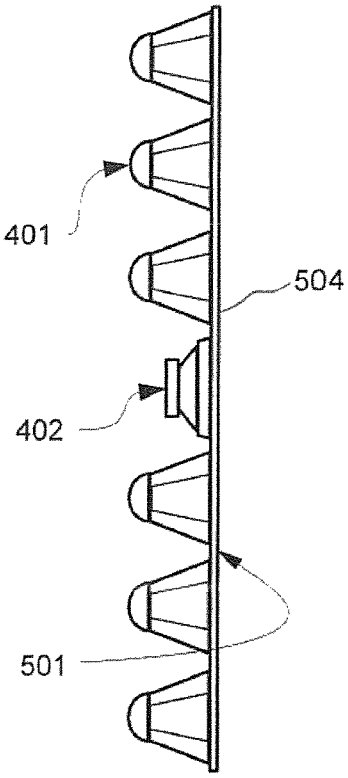
FIG. 6
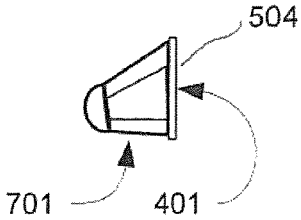
FIG. 7

BUILDING SECURITY SYSTEM

CROSS-REFERENCE TO RELATED APPLICATIONS

This application is a Continuation of U.S. patent application Ser. No. 15/149,476 filed May 9, 2016, now U.S. Pat. No. 9,886,831, which claims the benefit of U.S. Provisional Patent Application Ser. No. 62/158,225, filed May 7, 2015, the entire disclosures of which are incorporated by reference herein.

FIELD

Embodiments of the present invention are generally related to building security systems. More particularly, a building security system that utilizes visual and/or aural output (e.g., light and sound) to slow and impair an armed assailant is provided.

BACKGROUND

The United States continues to experience significant loss of human life through attacks perpetrated with firearms. Between 2000 and 2012 the median response time for law enforcement to arrive on scene was three minutes, and in 92% of the cases response time was under seven minutes. While such response performance may represent successful police operations, in approximately half of those events injuries and killings occurred before law enforcement personnel arrived on-scene.

While such events can occur at a great variety of indoor and outdoor locations, occupants of certain building types—schools, work places, and houses of worship—have been targeted by perpetrators of such attacks. A common countermeasure often employed in these buildings is an armed security presence. Unfortunately, many organizations cannot afford the cost of maintaining a building or unit security officer, and there is typically a positive correlation among the effectiveness of the officer, their level of training and experience, and the cost of deployment. Additionally, some organizations that believe an armed security presence projects an negative public impression. Furthermore, liability concerns surrounding the potential for a wrongful death resulting from the misapplication of deadly force have been an impediment to the use of lethal counter-measures.

Portable, manual, nonlethal, and non-injurious weapons are increasingly employed in numerous military and civilian contexts. For example, rifle-mounted direct-energy weapons, e.g., green laser "dazzler" units, are used by the U.S. military at security checkpoints. Because dazzlers emit a relatively narrow light beam, the effectiveness of the weapon depends upon the ability of a skilled operator to continuously maintain the beam on an assailant's eyes. The green laser dazzler is considered effective at a range of tens to hundreds of meters, but is not suitable for indoor, close-range use. Police officers commonly employ high-intensity flashlights, often with stroboscopic function, to confuse and impair suspects. Such lightweight, battery-powered units are necessarily of limited intensity and coverage area and are typically employed as an adjunct to, rather than a substitute for, firearms.

Sonic weapons such as the Long-Range Acoustic Device (LRAD), produced by the LRAD Corporation, have been employed to control crowds, disperse riots, and deter pirates. While the LRAD is gradually demonstrating its efficacy, the LRAD system is unsuitable for use indoors at close range.

Stun grenades or flash-bangs employ both a single blinding flash and a loud bang to temporarily disorient enemies in military and police actions. Exposed personnel experience disorientation, confusion, and loss of coordination and balance. While these systems have garnered widely-accepted efficacy, and their effects are intended to be temporary, the extreme intensity of their operation presents a significant risk of permanent injury or death. Consequently, stun grenades are generally classified as "less-lethal weapons," and their legal use in civilian contexts remains strictly limited.

The foregoing discussion is primarily concerned with portable devices that have many drawbacks. Portable, handheld, and vehicle-mounted devices are more vulnerable to potential theft and abuse than fixed and permanently-installed alternatives. Portable devices are also unsuitable for fixed installations, because they often feature narrow fields of operation, limited effectively areas, or require operation by skilled personnel.

Thus it has been a long-felt need to provide a non-injuring security system capable of incapacitating one or more armed assailants.

SUMMARY

As will be apparent to one of ordinary skill in the art upon review the foregoing, embodiments the present invention provide a fixed disturbance source suitable for a defined, indoor space. The contemplated system is non-injurious, even though the light or sound intensity levels emitted thereby would potentially be harmful if emitted by a handheld device.

Some embodiments of the present invention are directed to solving the problems and disadvantages of the prior art. More specifically, the system of one embodiment employs high-intensity visual and aural stimuli in enclosed environments at such frequency, duration, and intensity to substantially interfere with an armed assailant's ability to effectively aim and operate firearms and other weapons and, thus, their ability to target victims and inflict injury before law enforcement arrives on scene. The frequency, duration, and intensity of the stimuli are carefully calibrated to produce no permanent injuries to any person exposed to the system, including the assailant. As the proposed system is non-injurious and non-lethal, existing on-site personnel with minimal training may be more readily authorized to operate the system and, thus, the system is more likely to be deployed. Therefore, it is more likely that the system will prevent or reduce injuries and fatalities when compared to prior art.

The system of one embodiment employs a physically obvious manual switch or panic button engaged by school personnel or office employees to activate the visual or aural impairment devices. Further embodiments of the disclosed invention provide automatic activation of the system via sensors adapted to detect signs of potential security threats in many forms including gunfire report audio signature, the presence of gunpowder or explosive materials, or other forms. Additional embodiments of the disclosed invention provide activation of the system via either wired or wireless remote control operated by law enforcement. In still other embodiments, system activation also engages an automatic security door lock that may prevent an assailant from penetrating further into the building. The additional features and advantages of embodiments of the disclosed invention will become more readily apparent from the following description, particularly when taken together with the accompanying drawings.

As mentioned above, it is another aspect of some embodiments of the present invention to provide light and sound emitting devices in a relatively small space, such as a building foyer or entryway. Emitting light or sound in a small area will help achieve maximum intensity levels. In addition, some embodiments of the present invention contemplate capitalizing on the reflective nature of some walls, ceilings, and floors, which makes it easier to ensure that the light and sound energy reach every portion of the target area. Sometimes the walls, ceilings, or floor of a target area in which the light or sound emitting devices or deployed are coated with a material that enhances such reflectivity.

It is yet another aspect of embodiments the present invention to provide a system that requires minimal training to deploy. More specifically, the control system used by some embodiments the present invention is preset and monitored such that a simple engagement of an initiation switch (manually or remotely) is all that is required. Once initiated, the control system will control the amount of light or sound emitted. This aspect of some embodiment of the present invention address a drawback of prior art handheld devices that can provide light or sound in such intensities to cause permanent damage to assailants and potential victims if deployed incorrectly. Stated differently, embodiments the present invention are designed to reduce human error that often occurs when using handheld devices. It follows that the contemplated system reduces human error associated with operating handheld devices, which can be very difficult when the operator is under fire or under a high level of stress.

It is another aspect of embodiments the present invention to provide many light/sound emission points in a fixed space. Using an array of emitters as opposed to a single, perhaps handheld, light/sound emission device has the advantage of allowing the range of each emitter to be limited to an ideal eye-to-light emitter distance and ear-to-sound emitter distance. Providing a plurality of fixed emitters and range limiting allows the control system to deliver optimal maximum/minimum light/sound intensity levels the armed assailant experiences. For example, the system of one embodiment of the present invention employs light/sound emitters on all surfaces of the building's entryway, which includes the walls, ceiling, and floor. In operation, the emitters put out pulsing patterns of light and sound that achieve a predetermined intensity. As one of ordinary skill in the art will appreciate, this system has advantages over the prior art systems that simply employ an alarm and a single-lamp high-intensity light fixture—an LED board of a few square inches versus hundreds of square feet of surface area that emits disabling light and sound. Regarding the prior art systems, an assailant could simply turned their head away from the source of the disturbance to mitigate its disabling effects. And, to be effective, the prior art system must emit light/sound at such an intensity that could be damaging to innocent bystanders. By providing an array of emission devices, the intensity of each can be reduced, increasing the margin of safety while not affecting their disabling capabilities.

Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device; and wherein the initiation switch is manual and accessible only to authorized personnel.

Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device; and wherein the at least one light and sound emitting devices possess the ability to emit a verbal warning Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device; and wherein the walls of the building entryway reflect at least one of light and sound Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device; and further comprising a sensor located in the entryway, and wherein the initiation switch upon receiving a signal from the sensor activates the light and sound emitting devices, wherein the sensor is a motion sensor, and a control system is provided that activates the at least one light and sound emitting devices only when occupants of the space are in motion.

Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device; and wherein the at least one light and sound emitting devices are installed in at least one of the building hallways and interior rooms in addition to the entry way, wherein the at least one light and sound emitting devices are selectively activated in a preselected zone, and not in the entire building.

Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device, and wherein the at least one light and sound emitting device comprises a plurality of light and sound emitting devices located in the entryway or equivalent space of the building, wherein the plurality of light and sound emitting devices are mounted intra-wall.

Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device, and wherein the at least one light and sound emitting device comprises a plurality of light and sound emitting devices located in the entryway or equivalent space of the building, wherein each of the plurality of light and sound emitting devices are adapted to deliver different visual or aural impairment means.

Some embodiments of the present invention comprise a building security system adapted to disable one or more armed assailants, comprising: at least one light and sound emitting device positioned in an entryway or equivalent space of a building, wherein the at least one light and sound emitting device delivers a high-intensity, rapidly fluctuating, non-injurious light and sound within a defined range of variability as experienced by occupants of the space across all likely potential occupant positions in the space; and an initiation switch that activates the at least one light and sound emitting device; and a deactivation switch that deactivates the at least one light and sound emitting device, and wherein the at least one light and sound emitting device comprises a plurality of light and sound emitting devices located in the entryway or equivalent space of the building, wherein the plurality of light and sound emitting devices are configured to emit light and sound such that the maximum ratio of the shortest to the longest light emitter to eye distance is about 1 to 5, and the shortest to the longest sound emitter to ear distance is about 1 to 10.

Some embodiments of the present invention comprise a method of securing a building under in an active shooter situation, comprising: identifying an armed assailant; initiating a non-lethal disabling system; activating a plurality of emitting devices, the emitting devices issuing light and sound at a level that disables the armed assailant, wherein the light and sound levels issued by each emitting device of the plurality thereof would not disable the armed assailant, but wherein the aggregate effect of the plurality of the emitting devices provides light and sound energy that disables the armed assailant; disabling the armed assailant; notifying law enforcement personal of the active shooter situation; assessing threat level; and deactivating the plurality of emitting devices if the threat level is below a predetermined level, and further comprising issuing an automated verbal warning at a predetermined time after initiating the non-lethal disabling system.

The Summary is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary as well as in the attached drawings and the Detailed Description of the Invention and no limitation as to the scope of the present invention is intended by either the inclusion or non-inclusion of elements, components, etc. in this Summary. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 4 is a front elevation view of an emitter unit of one embodiment of the present invention;

FIG. 5 is a front elevation view of a lens sheet used by the emitter units of some embodiments of the present invention;

FIG. 6 is a top view of an emitter unit of one embodiment of the present invention;

FIG. 7 is a side view of the emitter unit shown in FIG. 6;

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
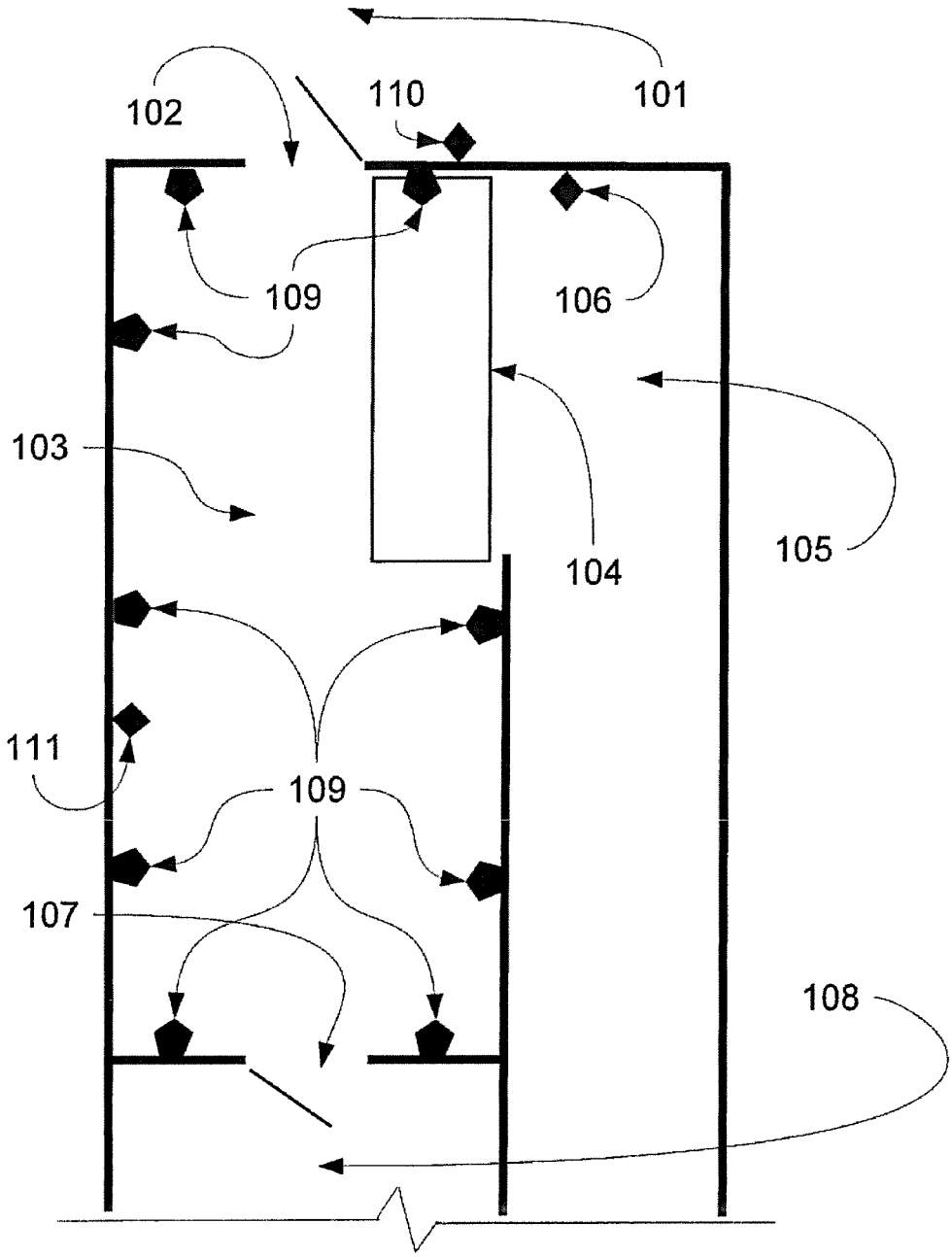
FIG. 1 is a schematic depicting a security system of one embodiment of the present invention installed in a building.

FIG. 1 depicts a security system building installation in accordance with embodiments of the present invention. The system is designed to be used in any building violent attacks may occur, such as houses, schools, universities, jails, prisons, mental health facilities, hospitals, etc. Users of the building arrive via the exterior 101 and enter the facility through entry door 102 into a foyer 103. Building staff consistently occupy a reception staff area 105 behind a reception desk 104. As users arrive building staff perform normal security function of observation or personal identification checks, etc. at the reception desk 104. Building users then normally proceed to the building interior 108 via a security door 107 that is normally closed and unlocked. Upon identification of a significant threat from a building user, the staff engages a panic button 106 that closes a system circuit. Alternatively, a wired or wireless report sensor 111 automatically causes the system circuit to close upon detecting gunfire. The system then activates a plurality of visual and aural emitters 109 and operates an automatic security door 107 that locks in a closed position. Law enforcement will assess the threat and, if eliminated, engage a defeat switch 110. The defeat switch 110 opens the circuit and the system deactivates, which terminates emitters 109 operation and unlocks the security door 107. The staff then resets the panic button 106 and the defeat switch 110 and the system is returned to a standby mode.

Visual and aural emitters are employed as vision and hearing are the primary senses armed assailants employ in their attempts to target potential victims. The emitters 109 used by some embodiments of the present invention comprise the combination of two distinct types of electrically-driven emitting devices: an audible siren and a visible light fixture. The audible siren generates a high-intensity warble tone or other highly distracting sound pattern at sufficient intensity. Thus the siren masks sounds made by potential victims and distracts the assailant. However, the sound energy the sirens produce are insufficient to permanently damage hearing of building users, including the assailant. The light fixture generates intermittent or stroboscopic light at frequencies, durations, and intensities so as to be highly distracting to the assailant, yet insufficient to result in permanent damage to the vision of building users, including the assailant.

Typical solar luminance at sea level under optimal conditions is approximately 100,000 lumens per square meter or lux. Optical exposure to 100,000 lux, i.e. staring at the sun, for a duration of several minutes to tens of minutes is sufficient to cause eye damage. 10,000 lux is an established recommended maximum illumination level for critical tasks, such as surgery, and is considered safe for exposure durations of several hours. Thus the system of one embodiment delivers an average light intensity in the range of approximately 2,000 to 20,000 lux. Additionally, any building user, including the assailant, may simply close their eyes as an additional hedge against any potential damage to vision. 2,000 to 20,0000 lux is approximately 4 to 40-times typical illuminance found in an office space or school building. As such, building users may perceive such luminance as highly intense and disruptive.

The primary benefits of stroboscopic implementation employed by some embodiments are twofold. 1) induction of flicker vertigo; and 2) impairment of motion perception. Flicker vertigo, which has also been termed the "Bucha effect," is an imbalance in brain cell activity caused by exposure to flickering or flashing bright light. Common effects include disorientation, vertigo, and nausea. High-intensity strobe lights, operating in the range of 1 to 20 cycles per second (Hz), have been shown to induce the effect. Thus, assailants in the foyer 103 may be impaired by flicker vertigo in their attempts to target building users with firearms.

The human eye requires time to adapt to various light levels. Pupillary action is the most rapid adaptation mechanism of the eye and mean pupil cycle time is known to be in the range of approximately 752 to 980 milliseconds. Thus the human eye has no coping mechanism able to respond quickly to compensate for a strobe frequency of 2 Hz or greater, 500 milliseconds or less cycle time. A stroboscopic light operating at 2 Hz or greater, and at an intensity at least several times that of ambient light, presents a stop-motion effect to human vision where movement of objects is perceived as a series of distinct static images. The effect may impair the ability of an assailant to track or anticipate the motion of building users in the foyer 103.

An accepted workplace standard for permissible exposure time to continuous time-weighted average noise is 85 decibels (dBA) for an 8-hour work shift. For every 3 dBAs over 85 dBA, the permissible exposure time is cut in half. Thus permissible exposure at 100 dBA is approximately 15 minutes and at 109 dBA it is 112.5 seconds. Analogous to stroboscopic function, embodiments of the present disclosure employ an aural warble or similar tone of varying sound pressure intensity such that the average sound pressure level remains within the range of 100 dBA to 109 dBA, while the peak sound pressure level can reach well above the average momentarily maximizing the perceived intensity and effective distraction or disorientation while remaining non-injurious. Furthermore, building users, including the assailant, may simply plug their ears with their fingers as an additional hedge against any potential damage to hearing.

Providing a plurality of light and sound emission points as contemplated by embodiments of the present disclosure presents the advantage of delivering a more consistent level of emission intensity across an indoor space compared to prior art. As both light and sound conform to the inverse square law, that intensity is inversely proportional to the square of the distance from the source, the distance from emission source to building user may be an important variable. The greater the number of emission points, the smaller the potential maximum variation in emitter-to-ear/eye distance. Thus, for a given maximum acceptable cumulative exposure across a given finite space, a plurality of emission points will allow the system to operate safely at a higher average intensity level compared to a single emission point, which may increase effectiveness. For example, assuming a target delivered luminance of 4 to 40-times the ambient level, a range of a factor of ten, sufficient emission points would be required such that the range of emitter-to-eye/ear distances for all likely head positions are within a factor of 3.16. If the shortest likely emitter-to-eye/ear distance is two feet, then the maximum distance would be 6.32 feet, indicating a density of emission points at least several times that of prior art. Additionally, a plurality of emission points may prove more difficult for an assailant to mechanically defeat compared to prior art. For example, a single light fixture emission point might be quickly defeated by covering or breaking the lamp, whereas a plurality of such fixtures may require significant effort and time to defeat.

Furthermore, when compared to prior art, the highly directional nature of light may mean that radiation from a plurality of emission points prove more difficult for an assailant to mitigate by simply manipulating his location within the foyer 103 or his angle of view.

Figure 2:
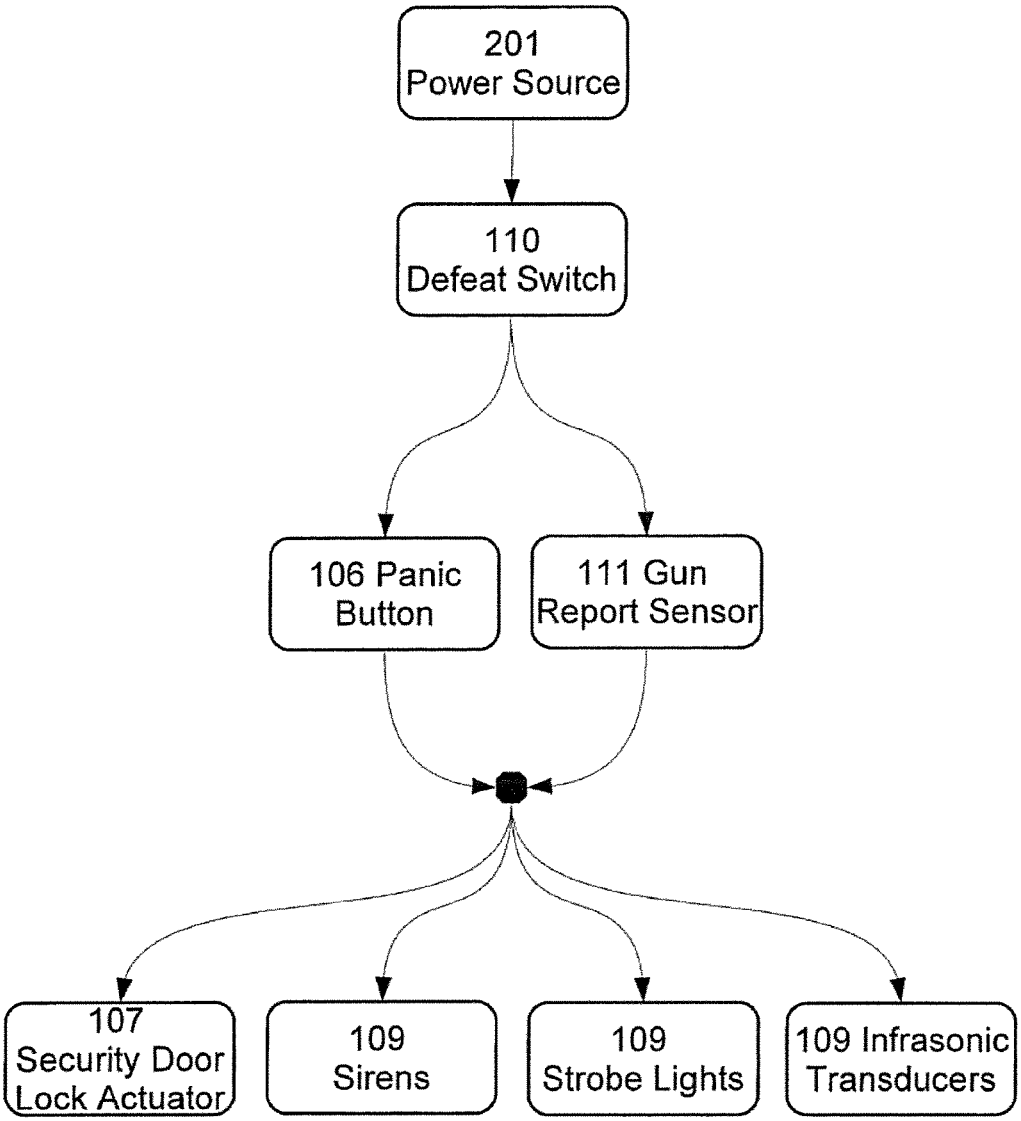
FIG. 2 depicts the major components of the security system in accordance with some embodiments of the present invention.

FIG. 2 depicts the components of the disablement system in accordance with some embodiments of the present invention. A power source 201 is common building electrical current which travels through the defeat switch 110 to supply the panic button 106 and a gun report sensor 111. The panic button 106 is a manual switch that is normally open. The gun report sensor 111 configured with a microphone functions as an automatic switch, normally in the open position and closing when the sonic signature of a weapon firing is received. When the panic button 106 and/or the gun report sensor 111 have been triggered, instantaneous and ongoing power is supplied to the emitters 109, and to the mechanical door lock actuator 107. The defeat switch 110 is a normally-closed power switch keyed, or otherwise limited, to authorized use exclusively. Only authorized personnel such as law-enforcement can engage the defeat switch and deactivate the system.

Figure 3:
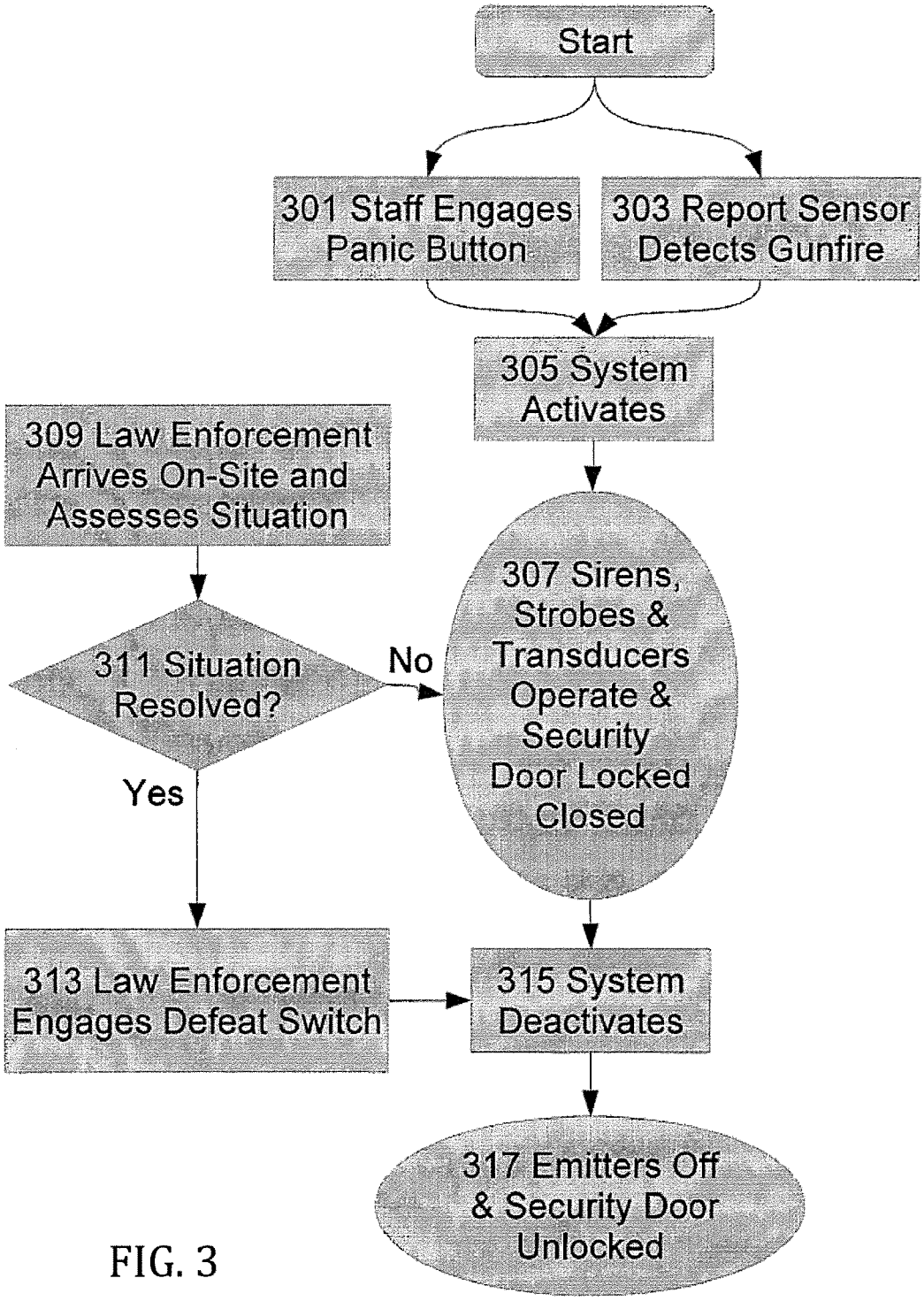
FIG. 3 is a flowchart showing a method of impairing an armed assailant employed by the security system of one embodiment of the present invention.

FIG. 3 is a flow chart depicting aspects of a method for impairing the ability of an assailant to inflict injury upon building users in accordance with some embodiments of the present invention. Either building staff identifies a significant threat and operate the panic button 301, or the report sensor detects gunfire 303, either of which activates the system 305. Instantaneously, emitters begin to operate 307 issuing a warble tone and/or stroboscopic light. The inner security door is also locked in its normal closed position. Once law-enforcement arrives on site 309, an assessment is made to determine if the situation has been resolved 311, or they can resolve it. If so, the defeat switch is engaged 313 by employing a key or other security access they possess, and the system deactivates 315 which ceases emitter operation and unlocks the security door 317. Until law enforcement can determine that the situation is resolved, the system will continue to operate.

In one embodiment of the system, the emitters 109 include a third type of electronic emission device, an infrasonic transducer. The resonant frequency of the human eye is estimated to be approximately 18.9 Hz. There is evidence that infrasound at or near this frequency can induce nausea and general discomfort. Such effects of infrasound are not fully felt immediately, but rather build over minutes of exposure. As such, the combination of instantaneous aural and visual impairment with infrasonic disorientation may provide greater duration of effectiveness, with one form of impairment increasing as other forms are possibly mitigated by assailant action.

In another embodiment of the present invention, one or more emitter electrical components are centrally located in a control unit connected to switches 106 and 111 and emitters 109.

In yet another embodiment of the present invention, the system incorporates a wireless remote activation trigger that allows law enforcement or other official personnel to activate and deactivate the system while maintaining a certain distance from the building.

In another embodiment of the present invention, the emitters contain operational programs that present a variable, rather than constant, operation mode. Either or both the sirens and light fixtures contain programs that deliver an initial, single burst of sound and/or light of significantly greater intensity than delivered during subsequent emission. Thus, the system initially functions akin to a distributed-source stun grenade, delivering an intense initial output to immediately discourage further penetration into the building by the assailant. Subsequent operating intensities are substantially lower such that total cumulative exposure to light and sound would remain non-injurious.

In another embodiment of the present invention, a motion-sensing device and controller unit are incorporated. Upon system activation the controller would employ the emitters to deliver an initial high-intensity burst of light and sound via emitters 109, put the system into a standby mode and then employ the sirens to deliver a stored verbal audio warning to building users to remain motionless or suffer further bursts. Upon sensing motion in the foyer 103, the controller would then deliver another burst, repeat the warning, and then go back into standby mode, and so on. The operational program would reflect limits on the frequency, number and intensity of bursts delivered such that total cumulative exposure to light and sound would pose low risk of permanent damage to hearing or vision.

In yet another embodiment of the present invention, multiple emitter units 109 are ganged in a linear array and mounted intra-wall, horizontally and flush to the interior wall surface of foyer 103, such that the emitters are less vulnerable to physical attack and present a workmanlike appearance.

In another embodiment of the present invention, upon system activation law enforcement or other organization is electronically notified of such.

In still yet another embodiment, the subject system is installed throughout an entire building or in all hallways and corridors.

In one embodiment, the subject system actives additional or alternative physical barriers such as automatically closing doors or gates.

In another embodiment, the system is zoned such that an activation in one part of the building activates the system in only a portion of the building.

In yet another embodiment, the system employs either visual or aural emitters.

FIG. 4 is a front view of an emitter unit 109. The contemplated emitter unit 109 is a ganged unit comprised of six light-emitting diode (LED) units 404, which may be housed within reflectors 401, and a piezoelectric siren 402. In some embodiments of the present invention, the light emitting devices are high intensity light beams as disclosed in U.S. Pat. No. 7,497,586, which is incorporated by reference herein. In operation, all or a portion of the LED units 404 may issue light energy. In addition, some of the LED units 404 may emit a steady light while others emit a pulsing light. As one of ordinary skill in the art will appreciate, the LEDs, or other light emitting devices may issue light in any color.

As discussed above, it is often desirable to provide light/sound emitters that are resistant to damage. FIG. 5 shows a lens sheet 501, constructed of a damage-resistant and translucent material such as polycarbonate, which protects the light/sound emitters positioned therebehind. When installed, the front surface 504 (see, FIG. 6) is flush or semi-flush with the wall, ceiling, or floor of a room. The central portion 502 of the lens 501 contains holes or employs other known methods to create an acoustically transparent portion in front of the siren 402. Additionally, the lens 501 may incorporate Fresnel or similar type of light-controlling capacity to enhance distribution of emitted light.

FIGS. 6 and 7 are top and side views, respectively, of an emitter unit 109. In one embodiment, the reflector 701 is used to intensify or alter the light emitted by the LED units 401 are asymmetrical. That is, the reflector 701 may employ faceted surfaces or other methods to amplify or redirect the light energy. Thus, if the LED units 401 are located above or below average standing eye level (i.e., a position less vulnerable to physical damage) the reflectors 701 will direct light energy towards assailant's eyes while maintaining desirable minimum emitter-to-eye distance. Asymmetrical reflector may be incorporated in various configurations to enhance multiple operational objectives.

Figure 8:
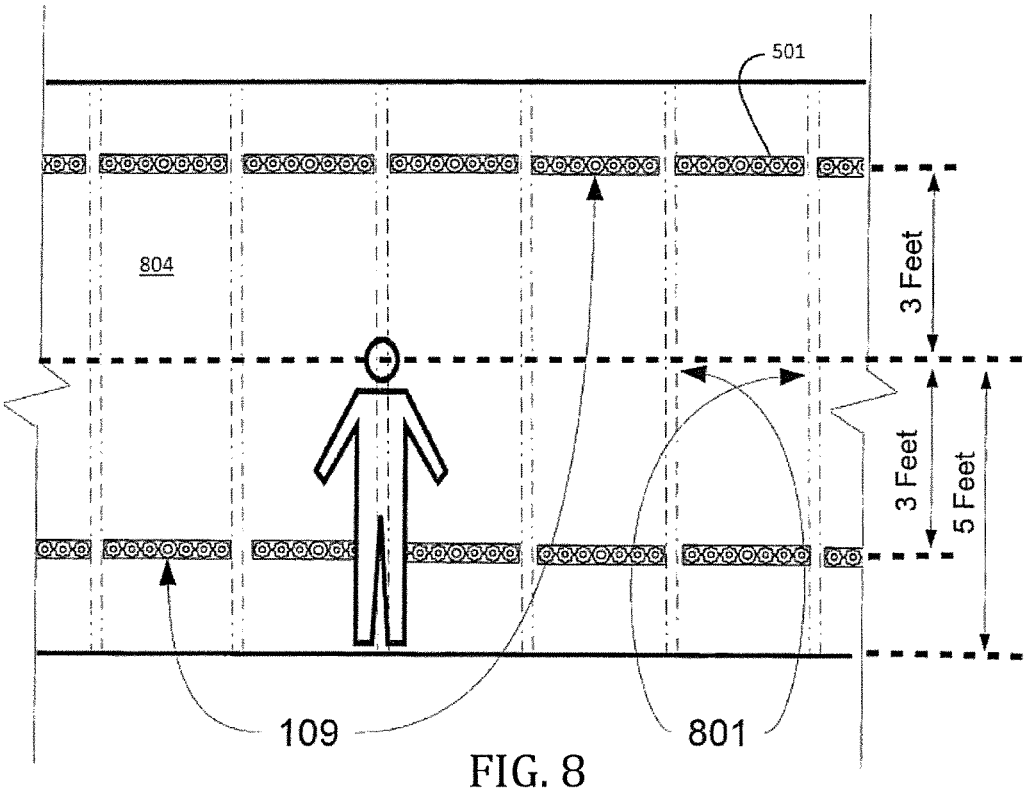
FIG. 8 is a representation of the security system of one embodiment of the present invention installed in a building entry way.
Figure 9:
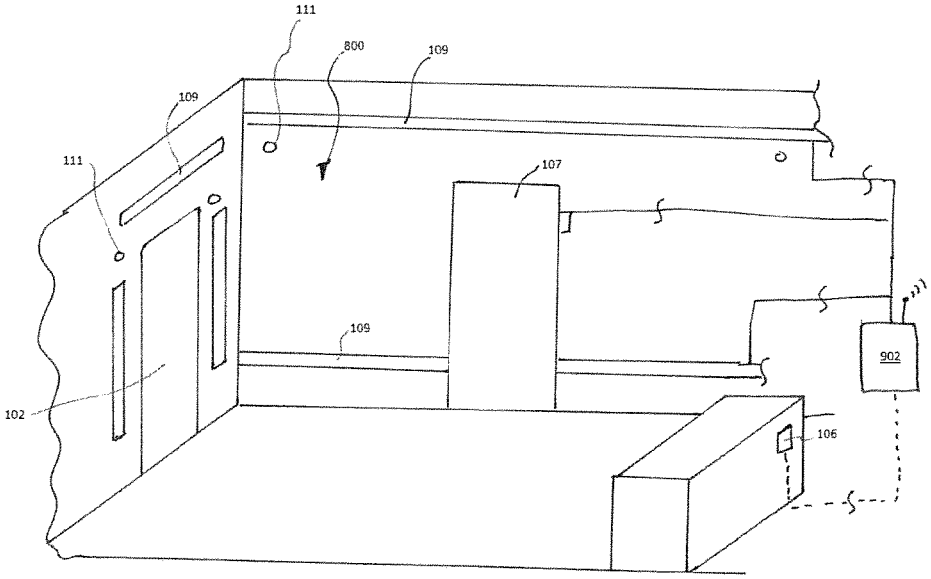
FIG. 9 is another representation of the security system of one embodiment of the present invention installed in an entry way.

FIGS. 8 and 9 show a building entryway equipped 800 equipped with a security system of one embodiment of the present invention. The emitter units 109 are sized and configured so as to mount, intra-wall with lens 501 flush to an interior wall surface 804 and horizontally between structural wall components 808 in new or existing conventional construction. In this example, the emitter units 109 are interconnected to vertical wall studs 801 located behind the interior wall. In FIG. 8, the emitter units 109 are installed completely around the room at two horizontal elevations equidistant from assumed mean eye height of 5 feet. If doorways or windows present an interruption in the contiguous horizontal installation, one or more emitter units 109, with asymmetrical reflectors 701 directed towards door or window, are installed vertically and adjacent to side of door or window frame (see, FIG. 9). The configurations of FIGS. 8 and 9 increase minimum typical emitter-to-eye or emitter-to-ear distance and, thus, deliver more consistent light and sound intensity across the entire space. Furthermore, such a distributed plethora of emission points significantly increases number and diversity of angles of reflected light and sound attack which generates a more even distribution of light and sound energy, thereby allowing the system to operate safely at greater intensity and with improved effectiveness.

FIG. 9 is an expanded view of the building entry way 800 shown in FIG. 8. Here, emitter units 109 are installed on an upper portion and lower portion of the wall. Emitter units 109 are also installed about the primary building entry 102, wherein the emitter units 109 employ reflectors as described above to direct light and sound in a predetermined fashion. In operation, when a gunshot is the disabling aspects of the security system are initiated when sensors 111, which are disclosed, for example, in WO2014/134217, which is incorporated by reference herein, detect a gunshot. As described above, the security system can also be initiated upon activation of a panic button 106. Upon initiation, a signal hub 902, which may have wireless capabilities, will direct the signal to a door lock actuator 102 that will close and lock doors 107 leading into the interior portion of the building. The signal hub 902 also directs the emitter units 109 to issue light/sound. After the threat has been mitigated, the controller unit 903 (See FIG. 10) will receive a signal from the signal hub 902 and direct the emitter units 109 to cease function.

Figure 10:
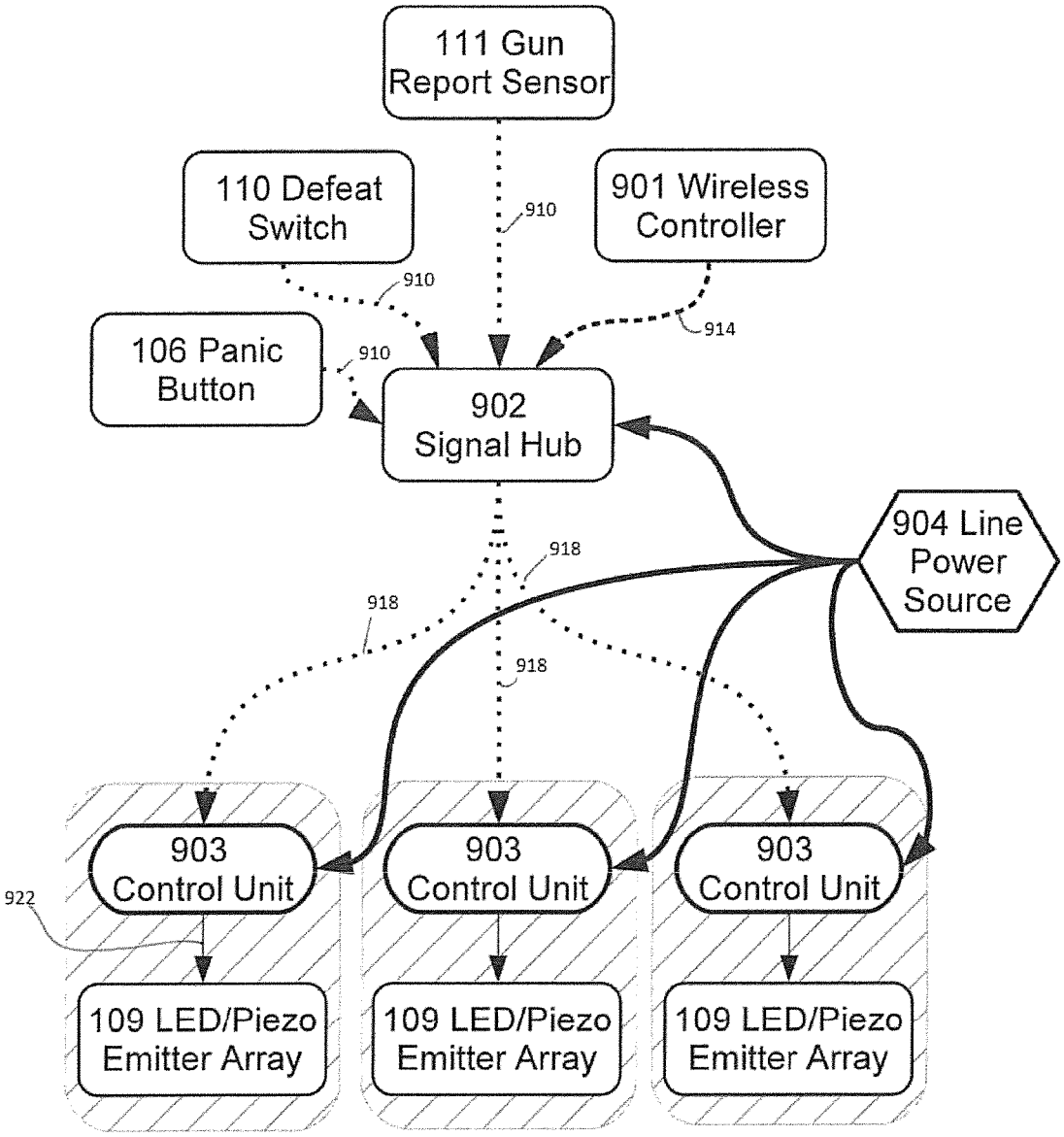
FIG. 10 depicts an electrical component and control configuration of one embodiment of the present invention.

FIG. 10 depicts electrical component and control configuration of one embodiment. The panic button 106, the defeat switch 110, and the gun report sensor 111 are adapted to send control signals 910 to a signal hub 902. Upon activation, a wireless controller 901 will transmit a control signal 914 to the signal hub 902. The signal hub 902 incorporates wired and wireless signal receivers, processor, and control logic program. Upon reception of the control signal 914, the signal hub 902 transmits low-voltage activation signal 918 to control units 903 via light-gauge signal wire (or wirelessly). The control units 903 of this embodiment are separate from but are installed immediately adjacent to LED/piezoelectric emitter arrays 109. The control units incorporate wired signal receiver, processor unit, and operational program that define light and sound intensities, durations, and frequencies. Upon receipt of the activation signal 918, the control units 903 employ an operational program and deliver carefully modulated operating current 922 to the LED/piezoelectric emitter array 109. The LED/piezoelectric emitter array 109 then emits light and sound into the entryway space.

Upon determination by law enforcement that situation is resolved, law enforcement either engages the defeat switch 110 or uses a wireless controller 901 to send deactivation signal to the signal hub 902 that transmits a deactivation command to the control units 903 and the control units 903 cease operation of the LED/piezoelectric arrays 109. The control units 903 incorporate power transformer such that high-power input from a line source 904, typically 120-Volt alternating current and depicted as heavy solid line, is converted into the form typically required by the LED and piezoelectric devices, 12 to 24-Volt direct current.

Once activated, this configuration provides an autonomous, cellular operation such that if a signal hub 902 or other components are destroyed, each control unit 903 emitter array 109 combination, depicted with hatched background, will continue to operate and impair ability of the armed assailant to target victims. Further advantages of embodiment include simplicity and reduced cost of installation, as the bulk of the wiring required is light-gauge signal wire from signal hub 902 to control units 903, as opposed to heavier gauge cable appropriate for line voltage. Light gauge signal wire is less expensive, easier to mechanically manipulate, physically capable of fitting in locations where heavier cable cannot and approved for simpler installation means by the Uniform Building Code and other forms of regulation.

Light and sound intensity delivered is determined through system configuration and design at the time of installation. The number, emission intensity, positions and orientations of LED units and Piezoelectric sirens of emitter units 109, the reflectivity of surfaces in the space and the size and shape of the space, as well as other characteristics of each specific implementation, are all analyzed and incorporated and the final resultant emission levels tested with appropriate instrumentation. The embodiment incorporates no means to measure or modulate light and sound levels during operation, and the operational program stored in control units 903 are static. The present embodiment presents advantages over prior art in that it functions independent of, and eliminates the costs and risks associated with, real-time interpretation and modulation of light and sound output, under demanding and physically threatening circumstances, either by human operator or machine-based means.

The aspects and features of the disclosed embodiments of the present invention can incorporate features from the following references, which are incorporated by reference in their entirety herein: U.S. Pat. Nos. 7,040,780, 7,980,720, 7,180,426, 6,190,022, 8,051,761, 7,794,102, 5,886,620, and 6,954,137, and U.S. Patent Application Publication Nos. 2006/0234191 and 2014/018782.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A building security system comprising:

at least one light and sound emitting device positioned in a building, wherein the at least one light and sound emitting device is operable to deliver a high-intensity, rapidly fluctuating, non-injurious light and sound within a defined range of variability as experienced by at least one occupant of the space;

wherein the at least one light and sound emitting device delivers flashing light at an average luminance level of about 2,000 to 20,000 lux and a frequency of about 2 to 20 Hz, across the space and over a period of from about 1 to 10 minutes;

wherein the at least one light and sound emitting device delivers a sound at a volume of between about 100 to 109 dBA;

a switch that is operable to activate and/or deactivate the at least one light and sound emitting device.

2. The system of claim 1, wherein the switch includes wireless communication means that allow for remote operation.

3. The system of claim 1, wherein the switch requires at least one of a key, authorized user-specific biometric identifier, numeric code, or specific wireless command to deactivate the at least one light and sound emitting devices.

4. The system of claim 1, further comprising an automated notification system that issues an electronic alert to law enforcement or other organization when the system is activated.

5. The system of claim 1, wherein a pre-established system operational program modulates the at least one light and sound emitting device to deliver variable levels of light and sound intensity over a predetermined operational period.

6. The system of claim 1, wherein the at least one light and sound emitting device includes an infrasonic transducer.

7. The system of claim 1, wherein the switch is associated with an automated door lock actuator that is adapted to perform at least one of locking an entryway door that leads to the building interior and deploying a physical barrier to the building interior.

8. The system of claim 1, further comprising a sensor, and wherein the sensor is operable to activate the at least one light and sound emitting device.

9. The system of claim 1, wherein the at least one light and sound emitting device is installed in at least one of a building hallway, an interior room, and an entry way.

10. The system of claim 1, wherein the at least one light and sound emitting device comprises a plurality of light and sound emitting devices located in the entryway or equivalent space of the building.

11. The system of claim 1, wherein the at least one light and sound emitting device comprises first and second light-emitting devices that extend completely around the space at two horizontal elevations equidistant from an assumed mean eye height.

12. The system of claim 1, wherein the at least one light and sound emitting device comprises at least two light-emitting devices provided vertically and adjacent to the side of at least one of a door frame and a window frame.

13. A method of securing a building under in an active shooter situation, comprising:

identifying an armed assailant;

initiating a non-lethal disabling system;

activating a plurality of emitting devices, the emitting devices issuing light and sound at a level that disables the armed assailant, wherein the light and sound levels issued by each emitting device of the plurality thereof would not disable the armed assailant, but wherein the aggregate effect of the plurality of the emitting devices disables the armed assailant;

wherein the emitting devices deliver flashing light at a luminance level of between about 2,000 to 20,000 lux and a frequency of about 2 to 20 Hz over a period of between about 1 to 10 minutes to disable the armed assailant;

notifying law enforcement personal of the active shooter situation; and deactivating the plurality of emitting devices if the threat level is below a predetermined level.

14. The method of claim 13, wherein the step of identifying an armed assailant comprises visual or auditory identification by an individual within the building, and wherein the step of initiating comprises physical contact with a button or keypad.

15. The method of claim 13, wherein identifying an armed assailant comprises visual or auditory identification by sensors within the building.

16. The method of claim 13, wherein initiating and deactivating is performed remotely using a wireless communication device.

17. A building security system comprising:

at least one light and sound emitting device positioned in a building, wherein the at least one light and sound emitting device is operable to deliver a high-intensity, rapidly fluctuating light and sound within a defined range of variability as experienced by at least one occupant of the space;

wherein the at least one light and sound emitting device delivers flashing light at an average luminance level of about 2,000 to 20,000 lux and a frequency of about 2 to 20 Hz, across the space and over a period of from about 1 to 10 minutes;

wherein the at least one light and sound emitting device delivers a sound at a volume of at least 100 dBA; and a switch that activates and/or deactivates the at least one light and sound emitting device.

18. The system of claim 17, further comprising an automated notification system that issues an alert to law enforcement or another organization when the system is activated.

19. The system of claim 17, further comprising a sensor, and wherein the sensor is operable to activate the at least one light and sound emitting device.

20. The system of claim 17, wherein the at least one light and sound emitting device is installed in at least one of a building hallway, an interior room, and an entry way.

* * * * *